US005885174A

United States Patent [19]

Barnes

[11] Patent Number: 5,885,174

[45] Date of Patent: Mar. 23, 1999

[54] ADJUSTABLE GOLF TEE SETTER

[76] Inventor: Douglas R. Barnes, 17 Heritage Dr., Prospect, Conn. 06712

[21] Appl. No.: 7,420

[22] Filed: Jan. 15, 1998

[51] Int. Cl.[6] ..... A63B 57/00

[52] U.S. Cl. ..... 473/386

[58] Field of Search ..... 473/386, 387, 473/378, 392, 393, 394, 396, 398, 400, 401, 402

[56] References Cited

U.S. PATENT DOCUMENTS

| | | | |
|---|---|---|---|
| 2,693,358 | 11/1954 | Dawson, Jr. | 473/398 |
| 3,074,719 | 1/1963 | McKee | 473/386 |
| 3,658,331 | 4/1972 | Driscoll | 473/386 |
| 4,660,868 | 4/1987 | Bressie | 473/386 |
| 4,989,868 | 2/1991 | Manko | 473/386 |
| 5,242,161 | 9/1993 | Wilkirson | 473/386 |

*Primary Examiner*—Steven Wong

[57] ABSTRACT

A new adjustable golf tee setter for consistently positioning a golf ball at a correct height for a tee shot. The inventive device includes an outer cylinder having a closed upper end, an open lower end, and a cylindrical side wall therebetween. The open lower end has a flange disposed around a periphery thereof. A cup portion is slidably received within the open lower end of the outer cylinder. The cup portion has a cylindrical configuration. The cup portion has a closed upper end and an open lower end. The open lower end is dimensioned for receiving an upper end of a golf tee therein.

4 Claims, 2 Drawing Sheets

ADJUSTABLE GOLF TEE SETTER

BACKGROUND OF THE INVENTION

1. Field of the Invention

The present invention relates to golf ball support structures and more particularly pertains to a new adjustable golf tee setter for consistently positioning a golf ball at a correct height for a tee shot.

2. Description of the Prior Art

The use of golf ball support structures is known in the prior art. More specifically, golf ball support structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf ball support structures include U. S. Pat. No. 5,242,161 to Wilkirson; U.S. Pat. No. 5,052,689 to Lettrich; U.S. Pat. No. 4,516,780 to Tabet; U.S. Pat. No. Des. 306,751 to Orton; U.S. Pat. No. 5,146,403 to Martino; and U.S. Pat. No. 3,883,144 to Lazow.

While these devices fulfill their respective, particular objectives and requirements, the aforementioned patents do not disclose a new adjustable golf tee setter. The inventive device includes an outer cylinder having a closed upper end, an open lower end, and a cylindrical side wall therebetween. The open lower end has a flange disposed around a periphery thereof. A cup portion is slidably received within the open lower end of the outer cylinder. The cup portion has a cylindrical configuration. The cup portion has a closed upper end and an open lower end. The open lower end is dimensioned for receiving an upper end of a golf tee therein.

In these respects, the adjustable golf tee setter according to the present invention substantially departs from the conventional concepts and designs of the prior art, and in so doing provides an apparatus primarily developed for the purpose of consistently positioning a golf ball at a correct height for a tee shot.

SUMMARY OF THE INVENTION

In view of the foregoing disadvantages inherent in the known types of golf ball support structures now present in the prior art, the present invention provides a new adjustable golf tee setter construction wherein the same can be utilized for consistently positioning a golf ball at a correct height for a tee shot.

The general purpose of the present invention, which will be described subsequently in greater detail, is to provide a new adjustable golf tee setter apparatus and method which has many of the advantages of the golf ball support structures mentioned heretofore and many novel features that result in a new adjustable golf tee setter which is not anticipated, rendered obvious, suggested, or even implied by any of the prior art golf ball support structures, either alone or in any combination thereof.

To attain this, the present invention generally comprises an outer cylinder having a closed upper end, and open lower end, and a cylindrical side wall therebetween. The open lower end has a flange disposed around a periphery thereof. The cylindrical side wall has a pair of diametrically opposed axial slots extending a length thereof. Each of the axial slots have side slots extending outwardly from opposite sides thereof at ¼ inch intervals. A cup portion is slidably received within the open lower end of the outer cylinder. The cup portion has a cylindrical configuration. The cup portion has a closed upper end and an open lower end. The open lower end is dimensioned for receiving an upper end of a golf tee therein. The cup portion has a pair of diametrically opposed posts extending outwardly therefrom. The posts are slidably received within the axial slots of the outer cylinder.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable golf tee setter apparatus and method which has many of the advantages of the golf ball support structures mentioned heretofore and many novel features that result in a new adjustable golf tee setter which is not anticipated, rendered obvious, suggested, or even implied by any of the prior art golf ball support structures, either alone or in any combination thereof.

It is another object of the present invention to provide a new adjustable golf tee setter which may be easily and efficiently manufactured and marketed.

It is a further object of the present invention to provide a new adjustable golf tee setter which is of a durable and reliable construction.

An even further object of the present invention is to provide a new adjustable golf tee setter which is susceptible of a low cost of manufacture with regard to both materials and labor, and which accordingly is then susceptible of low prices of sale to the consuming public, thereby making such adjustable golf tee setter economically available to the buying public.

Still yet another object of the present invention is to provide a new adjustable golf tee setter which provides in the apparatuses and methods of the prior art some of the advantages thereof, while simultaneously overcoming some of the disadvantages normally associated therewith.

Still another object of the present invention is to provide a new adjustable golf tee setter for consistently positioning a golf ball at a correct height for a tee shot.

Yet another object of the present invention is to provide a new adjustable golf tee setter which includes an outer cylinder having a closed upper end, an open lower end, and a cylindrical side wall therebetween. The open lower end has a flange disposed around a periphery thereof. A cup portion is slidably received within the open lower end of the outer cylinder. The cup portion has a cylindrical configuration. The cup portion has a closed upper end and an open lower end. The open lower end is dimensioned for receiving an upper end of a golf tee therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
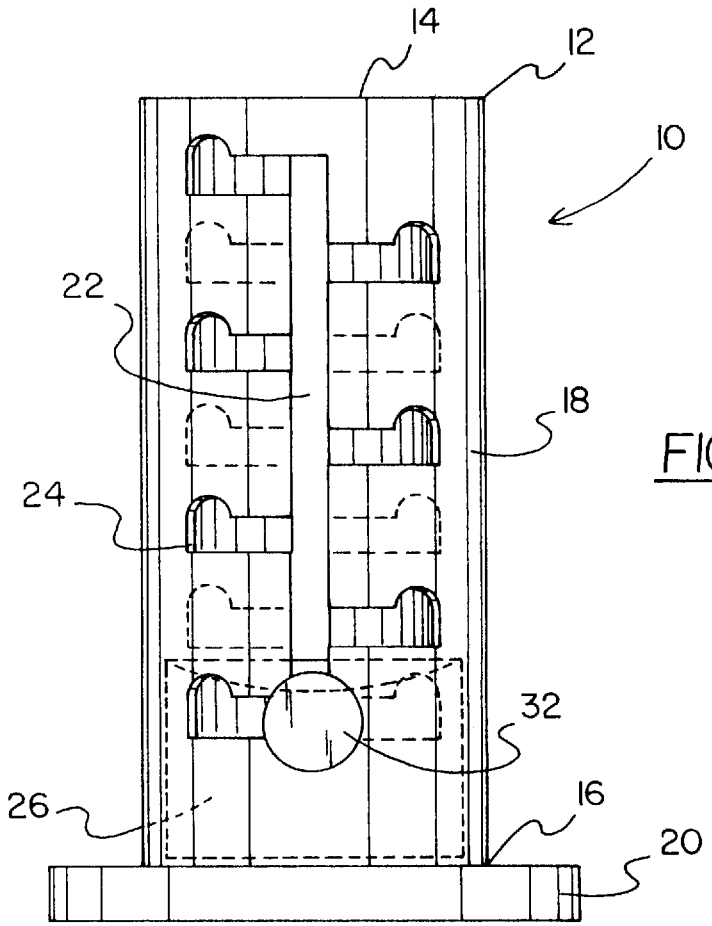
FIG. 1 is a side view of a new adjustable golf tee setter according to the present invention.
Figure 2:
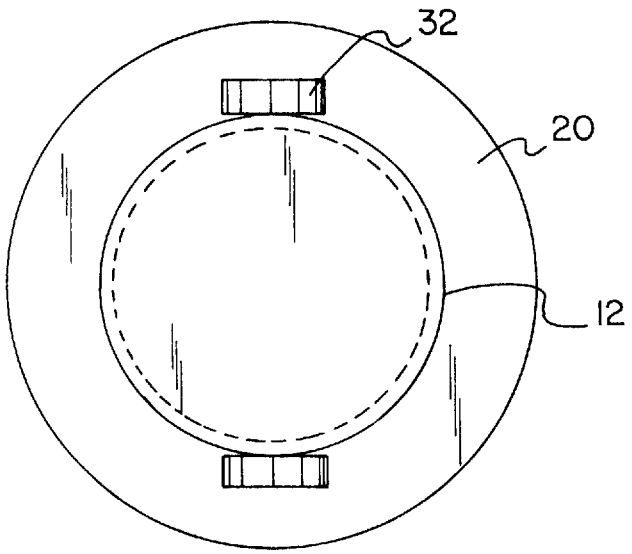
FIG. 2 is a plan view of the present invention.
Figure 3:
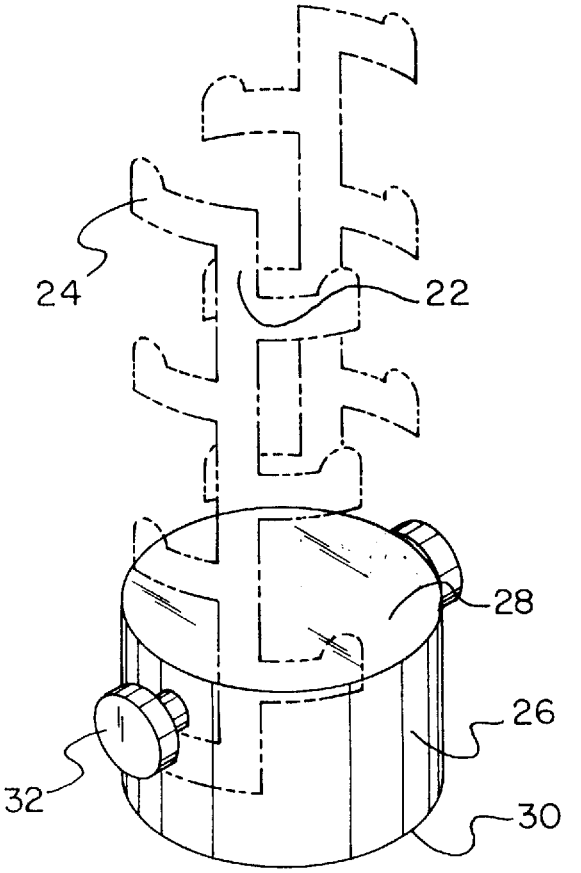
FIG. 3 is a perspective view of the cup portion of the present invention.
Figure 4:
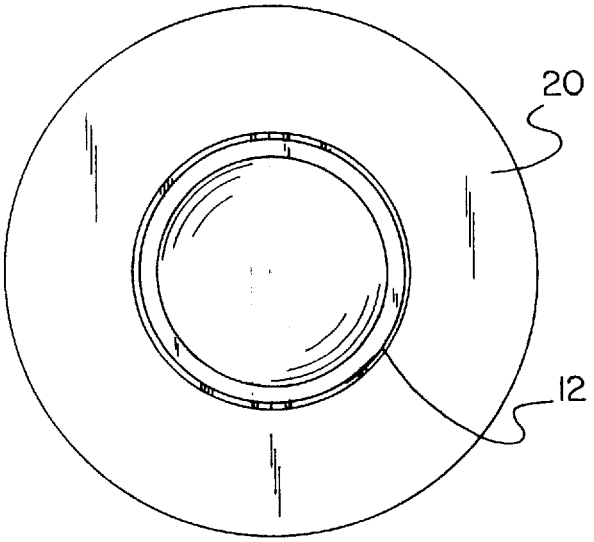
FIG. 4 is a plan view of the outer cylinder of the present invention.

With reference now to the drawings, and in particular to FIGS. 1 through 4 thereof, a new adjustable golf tee setter embodying the principles and concepts of the present invention and generally designated by the reference numeral 10 will be described.

As best illustrated in FIGS. 1 through 4, the adjustable golf tee setter 10 comprises an outer cylinder 12 having a closed upper end 14, and open lower end 16, and a cylindrical side wall 18 therebetween. The open lower end 16 has a flange 20 disposed around a periphery thereof. The cylindrical side wall 18 has a pair of diametrically opposed axial slots 22 extending a length thereof. Each of the axial slots 22 have side slots 24 extending outwardly from opposite sides thereof at ¼ inch intervals.

A cup portion 26 is slidably received within the open lower end 16 of the outer cylinder 12. The cup portion 26 has a cylindrical configuration and a height about ¼ that of the outer cylinder 12. The cup portion 26 has a closed upper end 28 and an open lower end 30. The open lower end 30 is dimensioned for receiving an upper end of a golf tee therein. The cup portion 26 has a pair of diametrically opposed posts 32 extending outwardly therefrom. The posts 32 are slidably received within the axial slots 22 and side slots 24 of the outer cylinder 12.

The posts each have an inboard portion with a first diameter less than the width of the side slots and an outboard portion with a second diameter greater than the width of the side slots. Each of the side slots have a width equal to that of the axial slots and a semicircular recess formed in a top edge of an end thereof such that upward pressure applied to the cup portion by a golf tee contacting the open lower end biases the posts into the semicircular recess. The side slots of each axial slot each extend from the axial slot in a direction opposite from that in which an adjacent side slot extends such that rotation of the cup portion moves the posts thereon from the axial slot into a selected one of the side slots and counter rotation of the cup portion moves the posts from the sides lots into the axial slot.

In use, a golfer would place the flared end of a conventional golf tee into the open lower end 30 of the cap portion 26, slide the posts 32 to the desired teeing height, and hold the outer cylinder 12 as he pushes the tee into a recipient ground surface. When the open lower end 16 of the outer cylinder 12 contacts the ground, the desired teeing height would be achieved and the golfer would lift the outer cylinder 12 off of the tee to leave the tee standing in the ground. A ball would be placed on the tee and hit in the normal manner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new adjustable golf tee setter for consistently positioning a golf ball at a correct height for a tee shot comprising, in combination:

an outer cylinder having a closed upper end, and open lower end, and a cylindrical side wall therebetween, the open lower end having a flange disposed around a periphery thereof, the cylindrical side wall having a pair of diametrically opposed axial slots extending a length thereof, each of the axial slots having side slots extending outwardly from opposite sides thereof at ¼ inch intervals; and a cup portion slidably received within the open lower end of the outer cylinder, the cup portion having a cylindrical configuration and a height about ¼ that of the outer cylinder, the cup portion having a closed upper end and an open lower end, the open lower end dimensioned for receiving an upper end of a golf tee therein, the cup portion having a pair of diametrically opposed posts extending outwardly therefrom, the posts being slidably received within the axial slots and side slots of the outer cylinder, the posts each having an inboard portion with a first diameter less than the width of the side slots and an outboard portion with a second diameter greater than the width of the side slots;

wherein each of the side slots has a width equal to that of the axial slots and further has a semicircular recess formed in a top edge of an end thereof such that upward pressure applied to the cup portion by a golf tee contacting the open lower end biases the posts into the semicircular recess, wherein the side slots of each axial slot each extend from the axial slot in a direction opposite from that in which an adjacent side slot extends such that rotation of the cup portion moves the posts thereon from the axial slot into a selected one of the side slots and counter rotation of the cup portion moves the posts from the side slots into the axial slot.

2. A new adjustable golf tee setter for consistently positioning a golf ball at a correct height for a tee shot comprising, in combination:

an outer cylinder having a closed upper end, and open lower end, and a cylindrical side wall therebetween, the open lower end having a flange disposed around a periphery thereof; and a cup portion slidably received within the open lower end of the outer cylinder, the cup portion having a cylindrical configuration, the cup portion having a closed upper end and an open lower end, the open lower end dimensioned for receiving an upper end of a golf tee therein;

said outer cylinder having a pair of diametrically opposed axial slots extending a length of the outer cylinder, each of the axial slots having side slots extending outwardly from opposite sides thereof at spaced intervals, wherein each of the side slots has a width equal to that of the axial slots and further has a recess formed in a top edge of an end thereof;

said cup portion having a pair of diametrically opposed posts extending outwardly therefrom, the posts being slidably received within the axial slots and side slots of the outer cylinder, the posts each having an inboard portion with a first diameter and an outboard portion with a second diameter greater than the first diameter and wherein upward pressure applied to the cup portion by a golf tee contacting the open lower end biases the posts into the recesses.

3. A new adjustable golf tee setter as set forth in claim 2 wherein the side slots of each axial slot each extend from the axial slot in a direction opposite from that in which an adjacent side slot extends.

4. A new adjustable golf tee setter as set forth in claim 2 wherein the side slots extend outwardly from opposite sides of the axial slots at ¼ inch intervals.

* * * * *